US012286323B2

(12) United States Patent
Oshiro

(10) Patent No.: US 12,286,323 B2
(45) Date of Patent: Apr. 29, 2025

(54) SHEET PROCESSING DEVICE

(71) Applicant: TOSHIBA TEC KABUSHIKI KAISHA, Tokyo (JP)

(72) Inventor: Toshiaki Oshiro, Izu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 192 days.

(21) Appl. No.: 18/109,892

(22) Filed: Feb. 15, 2023

(65) Prior Publication Data

US 2024/0270532 A1 Aug. 15, 2024

(51) Int. Cl.

*B65H 31/28* (2006.01)
*B65H 29/00* (2006.01)
*B65H 31/34* (2006.01)

(52) U.S. Cl.

CPC ..... *B65H 31/34* (2013.01); *B65H 29/001* (2013.01); *B65H 2301/541* (2013.01); *B65H 2404/1112* (2013.01)

(58) Field of Classification Search

CPC ..... H04N 1/0066; B65H 9/14; B65H 9/16; B65H 9/166; B65H 31/02; B65H 31/28; B65H 31/34; B65H 2301/36; B65H 2301/361; B65H 2301/363; B65H 2301/36112; B65H 2301/3611; B65H 2408/114; B65H 2404/70

USPC ..... 270/37, 58.12, 58.17, 58.27

See application file for complete search history.

(56) References Cited

U.S. PATENT DOCUMENTS

| | | | | |
|---|---|---|---|---|
| 6,799,759 | B1 * | 10/2004 | McNamara | B65H 37/04 270/58.11 |
| 7,862,016 | B2 * | 1/2011 | Takemoto | G03G 15/6538 270/32 |
| 8,752,819 | B2 * | 6/2014 | Sato | G03G 15/6544 270/58.12 |
| 10,781,066 | B2 * | 9/2020 | Kishimoto | B65H 37/06 |
| 11,034,180 | B2 * | 6/2021 | Ueno | B65H 37/06 |
| 2017/0242388 | A1 | 8/2017 | Matsuno et al. | |
| 2017/0322508 | A1 | 11/2017 | Taki | |

FOREIGN PATENT DOCUMENTS

| | | |
|---|---|---|
| JP | 2004-284762 | 10/2004 |
| JP | 2008-297059 | 12/2008 |

* cited by examiner

*Primary Examiner* — Leslie A Nicholson, III

(74) *Attorney, Agent, or Firm* — Amin, Turocy & Watson, LLP

(57) ABSTRACT

A sheet processing device in an embodiment includes a conveyance path, a stacker, a post processing section, and vertical alignment members. The conveyance path conveys sheets in a conveying direction and stacks the sheets. The stacker restricts a leading end of the conveyed sheets. The stacker is movable in the conveying direction. The post processing section processes the sheets further on an upstream side in the conveying direction than a position where the sheets are supported by the stacker. The vertical alignment members feed the sheets in the conveying direction toward the stacker. The vertical alignment members are enabled to come into contact with a bundle of the sheets supported by the stacker. The vertical alignment members are movable in the conveying direction integrally with the stacker.

17 Claims, 12 Drawing Sheets

SHEET PROCESSING DEVICE

FIELD

Embodiments described herein relate generally to a sheet processing device, an image forming apparatus, and methods relating thereto.

BACKGROUND

A sheet processing device performs post processing such as stapling or saddle folding on a vertically aligned sheet bundle. There has been demanded a sheet processing device that can prevent misalignment from occurring in a post-processed sheet bundle.

DETAILED DESCRIPTION

Figure 1:
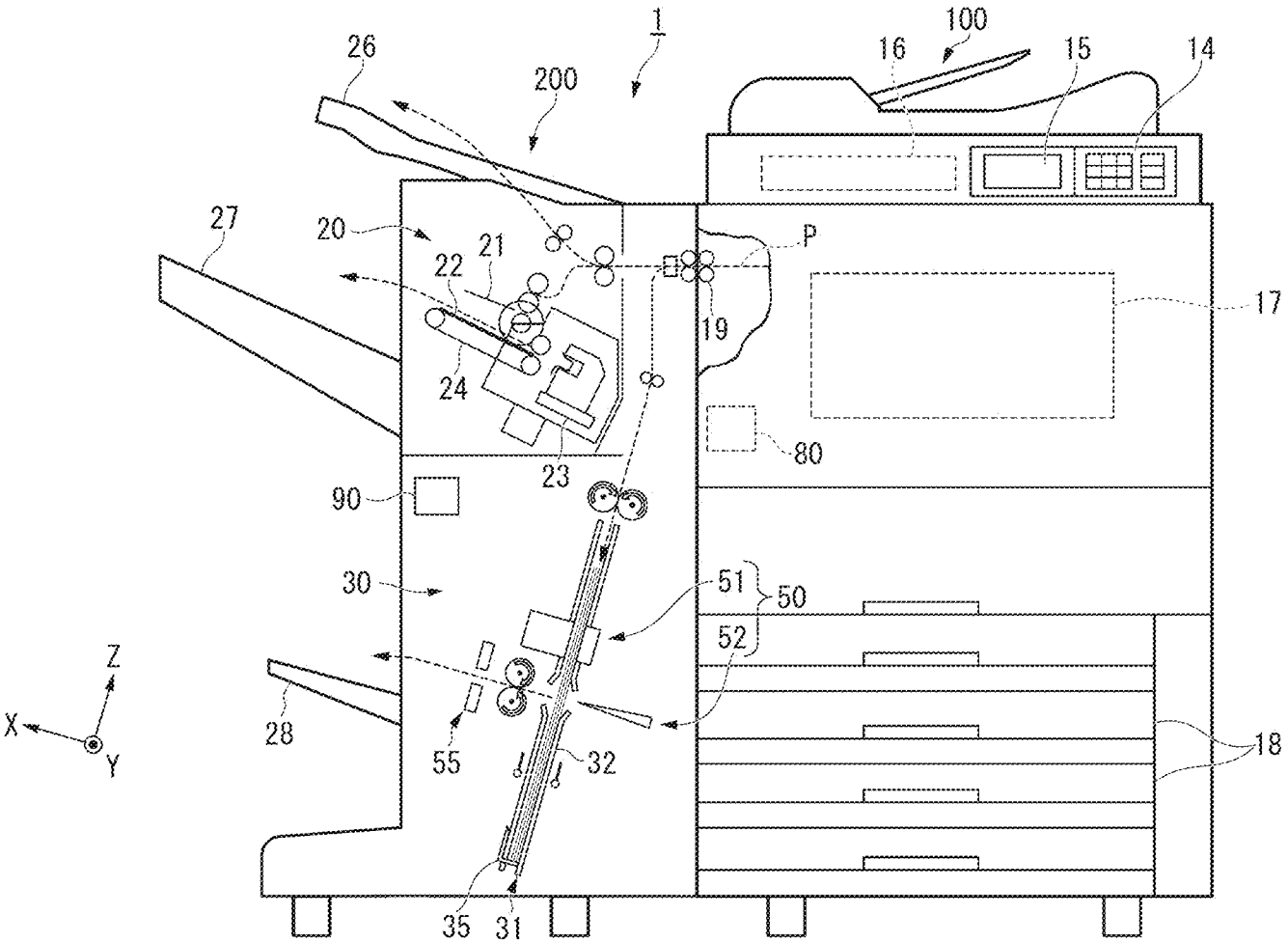
FIG. 1 is a schematic configuration diagram of an image forming apparatus.

A sheet processing device in an embodiment includes a conveyance path, a stacker, a post processing section, and vertical alignment members. The conveyance path conveys sheets in a conveying direction and stacks the sheets. The stacker restricts a leading end of the conveyed sheets. The stacker is movable in the conveying direction. The post processing section processes the sheets further on an upstream side in the conveying direction than a position where the sheets are supported by the stacker. The vertical alignment members feed the sheets in the conveying direction toward the stacker. The vertical alignment members are enabled to come into contact with a bundle of the sheets supported by the stacker. The vertical alignment members are movable in the conveying direction integrally with the stacker.

The sheet processing device in the embodiment is explained below with reference to the drawings. In the following explanation, components having the same or similar functions are denoted by the same reference numerals and signs. Redundant explanation of the components is sometimes omitted.

FIG. 1 is a schematic configuration diagram of an image forming apparatus 1. For example, the image forming apparatus 1 is disposed in a workplace. The image forming apparatus 1 includes an image forming apparatus main body 100 and a sheet processing device 200. The image forming apparatus main body 100 and the sheet processing device 200 are disposed adjacent to each other.

The image forming apparatus main body 100 is explained.

The image forming apparatus main body 100 forms an image on a sheet P (a recording medium) using a recording agent. The sheet P is, for example, plain paper or label paper. A specific example of the recording agent is toner. The toner is toner used as a decolorable recording agent or toner used as a non-decolorable recording agent.

For example, the image forming apparatus main body 100 is a multifunction peripheral. As illustrated in FIG. 1, the image forming apparatus main body 100 includes a display section 15, an operation section 14, an image reading section 16, a printer section 17, sheet storing sections 18, a paper discharge roller 19, and a first control section 80.

The display section 15 is an image display device such as a liquid crystal display or an organic EL (Electro Luminescence) display. The display section 15 displays various kinds of information concerning the image forming apparatus main body 100 and the sheet processing device 200.

The operation section 14 includes a plurality of buttons. The operation section 14 receives operation of a user. The operation section 14 outputs a signal corresponding to the operation performed by the user to the first control section 80 of the image forming apparatus main body 100. The display section 15 and the operation section 14 may be configured as an integral touch panel.

The image reading section 16 reads image information of a reading target based on brightness and darkness of light. The image reading section 16 outputs the read image information to the printer section 17.

The sheet storing sections 18 store sheets P used for image formation. The sheet storing sections 18 supply the stored sheets P to the printer section 17.

The printer section 17 forms an image on the sheet P based on image information generated by the image reading section 16 or image information received via a communication path. The printer section 17 includes an image forming section, a transfer section, and a fixing device. The image forming section forms an electrostatic latent image on a photoconductive drum based on the image information. The image forming section causes toner to adhere to the electrostatic latent image and forms a visible image. The transfer section transfers the visible image onto the sheet P. The fixing device heats and pressurizes the toner and fixes the visible image on the sheet P.

The paper discharge roller 19 is disposed near a paper discharge port of the image forming apparatus main body 100. The paper discharge roller 19 delivers the sheet P, on which the image is formed, to the sheet processing device 200.

Figure 2:
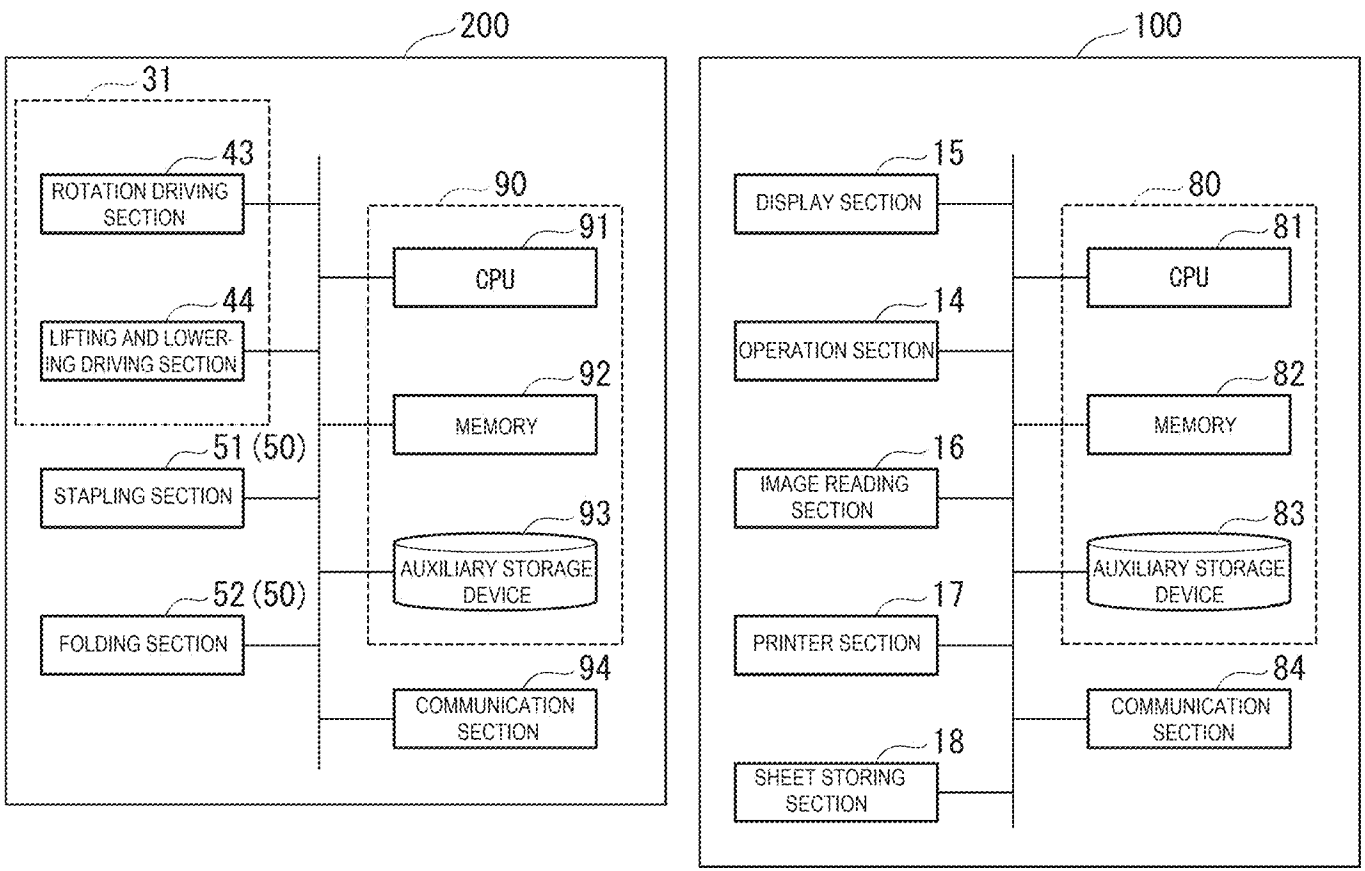
FIG. 2 is a block diagram illustrating a functional configuration example of the image forming apparatus.

FIG. 2 is a block diagram illustrating a functional configuration example of the image forming apparatus 1. As illustrated in FIG. 2, the image forming apparatus main body 100 includes a CPU (Central Processing Unit) 81, a memory 82, an auxiliary storage device 83, and the like connected by a bus and executes a program. The image forming apparatus main body 100 executes the program to thereby function as a device including the display section 15, the operation section 14, the image reading section 16, the printer section 17, sheet the storing sections 18, and a communication section 84.

The CPU 81 executes a program stored in the memory 82 and the auxiliary storage device 83 to thereby function as the first control section 80. The first control section 80 controls operations of the sections of the image forming apparatus main body 100 and the sheet processing device 200.

The auxiliary storage device 83 is configured using a storage device such as a magnetic hard disk device or a semiconductor storage device. The auxiliary storage device 83 stores information.

The communication section 84 includes a communication interface for connecting the image forming apparatus main body 100 to an external device. The communication section 84 communicates with the external device via the communication interface.

The sheet processing device 200 is explained.

As illustrated in FIG. 1, the sheet processing device 200 applies post processing to the sheet P on which an image is formed. For example, the post processing is stapling or saddle folding. The sheet processing device 200 includes a stapling mechanism 20, a saddle folding mechanism 30, and a second control section 90.

The stapling mechanism 20 includes a standby tray 21, a processing tray 22, and a stapler 23. The stapler 23 applies stapling to the peripheral edge portion of a plurality of sheets P. The stapled sheets P are conveyed by a conveyor belt 24 and discharged to a movable tray 27.

The sheet processing device 200 includes the movable tray 27 and an upper tray 26. The stapled sheets P are discharged to the movable tray 27. Unstapled sheets P are discharged to the upper tray 26.

First Embodiment

Figure 3:
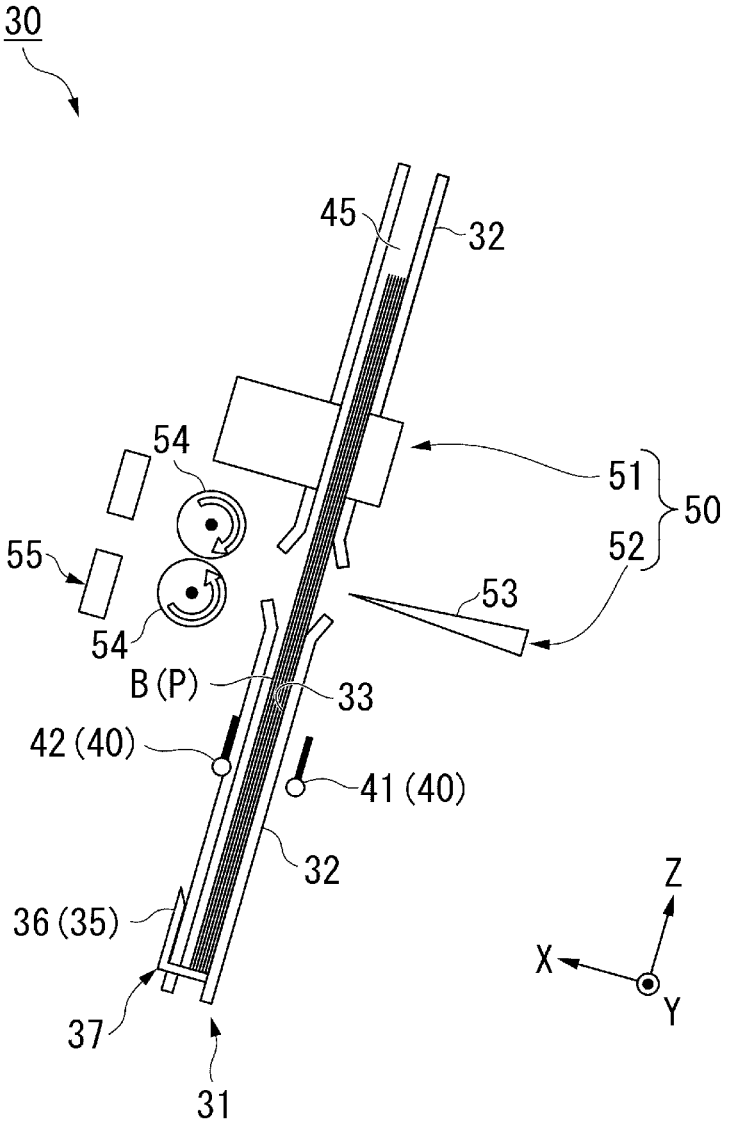
FIG. 3 is a front view illustrating a schematic configuration of a saddle folding mechanism in a sheet processing device in a first embodiment.

FIG. 3 is a front view illustrating a schematic configuration of the saddle folding mechanism 30 in the sheet processing device 200 in a first embodiment. As illustrated in FIG. 3, the saddle folding mechanism 30 includes a sheet supporting section 31, a post processing section 50, a lower tray 28 (see FIG. 1), and a conveyance path 45. The post processing section 50 includes a stapling section 51 and a folding section 52. The conveyance path 45 conveys the sheets P in a conveying direction and stacks the sheets P.

The sheet supporting section 31 is provided at the downstream end in the conveying direction of the sheets P in the conveyance path 45. The sheets P are stacked in the sheet supporting section 31. The sheet supporting section 31 includes a bed 32, a stacker 35, and vertical alignment members 40. The bed 32 includes a paper stacking surface 33 that supports the surface of the sheets P.

As a local coordinate system of the saddle folding mechanism 30, an X direction, a Y direction, and a Z direction of an orthogonal coordinate system are defined as follows. The X direction is the normal direction of the paper stacking surface 33 of the bed 32. A +X direction is a direction in which the sheets P are placed on the bed 32. The +X direction is a direction inclined further upward than the horizontal direction. The Z direction is a conveying direction of the sheets P in the saddle folding mechanism 30. A −Z direction is a direction in which the sheets P move toward the sheet supporting section 31 passing on the conveyance path 45. The Y direction is the width direction of the conveyance path 45 and is included in the horizontal direction.

The bed 32 has a substantially plate shape. The sheets P can be placed on the paper stacking surface 33 facing the +X direction of the bed 32. The sheets P placed on the paper stacking surface 33 are supported by the stacker 35. A pair of beds 32 is present on both sides in the Z direction across the folding section 52.

Figure 4:
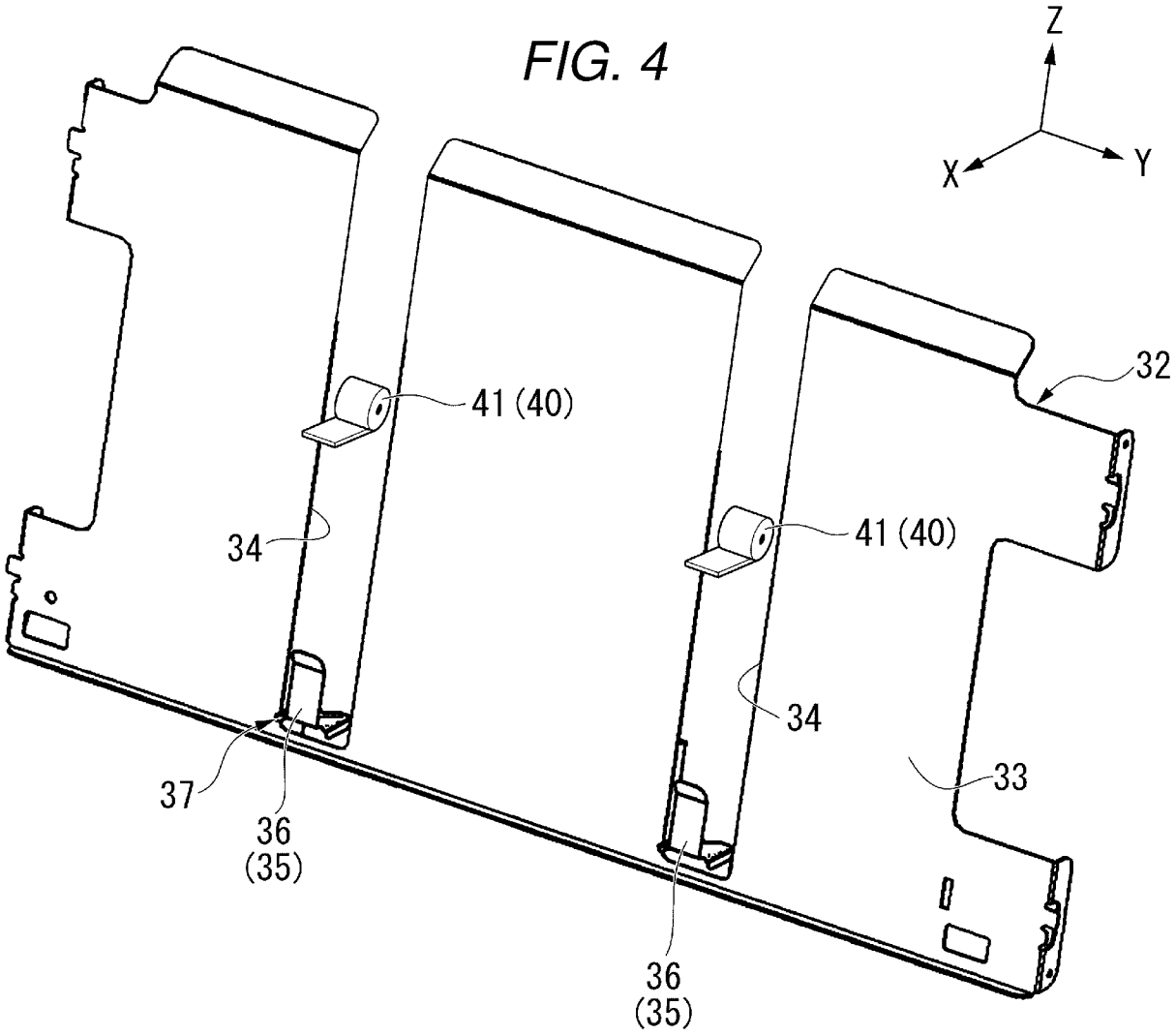
FIG. 4 is a perspective view of the periphery of a sheet supporting section.

FIG. 4 is a perspective view of the periphery of the sheet supporting section 31. As illustrated in FIG. 4, the bed 32 includes slits 34 that pierce through the bed 32 in the X direction. The slits 34 extend in the Z direction. A pair of slits 34 is disposed to be separated from each other in the Y direction. At least one of claws 36 of the stacker 35 and the vertical alignment members 40 is inserted through the slits 34.

As illustrated in FIG. 3, the stacker 35 restricts the leading end in the −Z direction of the sheets P conveyed to the sheet supporting section 31. The stacker 35 can supports an edge of one sheet P or a sheet bundle B including a plurality of sheets P. The stacker 35 includes a plurality of the claws 36. The plurality of claws 36 are disposed to be separated from one another in the Y direction. In this embodiment, the stacker 35 includes two claws 36. The plurality of claws 36 configure at least a part of a restricting section 37 that comes into contact with the sheets P from the −Z direction. In this embodiment, the restricting section 37 is configured by only the claws 36 of the stacker 35. The plurality of claws 36 are disposed on both sides in the Y direction with respect to the center in the Y direction in the sheets P. The claws 36 have a substantially L shape when viewed in the Y direction. The claws 36 are respectively inserted through the slits 34 of the bed 32. The claws 36 project in the +X direction from the slits 34 of the bed 32.

The stacker 35 is enabled to move in the Z direction. The claws 36 move in the slits 34 of the bed 32 if the stacker 35 moves in the Z direction. All the claws 36 integrally move in the Z direction. For example, the stacker 35 is driven by a moving mechanism disposed in a −X direction of the bed 32.

The vertical alignment members 40 are present in a position further in the −Z direction than the folding section 52. The vertical alignment members 40 feed the sheets P present in the conveyance path 45 in the −Z direction toward the stacker 35. The vertical alignment members 40 are present in a position facing the sheets P supported by the stacker 35. The vertical alignment members 40 are enabled to come into contact with the sheet bundle B supported by the stacker 35. The vertical alignment members 40 come into contact with the sheet bundle B from both the front and rear sides. The vertical alignment members 40 are plate-like paddles having flexibility. For example, the vertical alignment members 40 are made of rubber. The vertical alignment members 40 respectively rotate centering on axes extending in the Y direction. The vertical alignment members 40 cause the distal ends thereof to approach and separate from the sheets P according to the rotation. The vertical alignment members 40 direct the distal ends to the conveyance path 45 side to come into contact with the sheet bundle B. The vertical alignment members 40 bring the distal ends into contact with the sheet bundle B in a bent state to elastically come into contact with the sheet bundle B. The vertical alignment members 40 are movable integrally with the stacker 35 in the Z direction.

The vertical alignment members 40 include one or more first members 41 and one or more second members 42 facing each other across the sheets P supported by the stacker 35.

If the vertical alignment members 40 include a plurality of first members 41, the first members 41 are disposed to be separated in the Y direction. In this embodiment, the vertical alignment members 40 include two first members 41. The first members 41 are respectively inserted through the slits 34 of the bed 32. The first members 41 are respectively disposed in a +Z direction of the claws 36 of the stacker 35. The first members 41 are capable of coming into contact with the sheets P from the paper stacking surface 33 side of the bed 32 through the slits 34. If moving in the Z direction, the first members 41 move in the slits 34 in a state in which the first members 41 are in contact with the sheets P.

If the vertical alignment members 40 include a plurality of second members 42, the second members 42 are disposed to be separated in the Y direction. The vertical alignment members 40 include the second members 42 as many as the first members 41. The second members 42 are capable of coming into contact with the sheets P from the opposite side of the first members 41.

The vertical alignment members 40 come into contact with the sheets P only further on the inner side than both the ends of the entire restricting section 37 including all the claws 36 of the stacker 35 in the Y direction.

Force of the first members 41 coming into contact with the sheets P is smaller than force of the second members 42 coming into contact with the sheets P. For example, compared with the second members 42, the distal ends of the first members 41 more easily bend if the distal ends come into contact with the sheets P. The distal ends of the first members 41 are allowed to easily bend to reduce the force of the first members 41 coming into contact with the sheets P. For example, shapes such as thicknesses, widths, and lengths of the first members 41 and the second members 42 may be differentiated. For example, materials of the first members 41 and the second members 42 may be differentiated.

As illustrated in FIG. 2, the sheet supporting section 31 includes a rotation driving section 43 and a lifting and lowering driving section 44. The rotation driving section 43 drives to rotate the vertical alignment members 40. The rotation driving section 43 drives to rotate the first members 41 and the second members 42 independently of each other. For example, the rotation driving section 43 is a motor. The rotation driving section 43 rotates the first members 41 and the second members 42 in directions in which the first members 41 and the second members 42 each move in the −Z direction on the conveyance path 45. In the following explanation, the rotating direction of the first members 41 moving in the −Z direction on the conveyance path 45 is defined as a normal rotation direction. A normal rotation direction of the second members 42 is defined the same as the normal rotation direction of the first members 41. Reverse rotation directions of the first members 41 and the second members 42 are respectively defined as opposite directions of the normal rotation directions.

The lifting and lowering driving section 44 moves the stacker 35 and the vertical alignment members 40 in the Z direction. The lifting and lowering driving section 44 integrally moves the stacker 35 and the vertical alignment members 40 in the Z direction. The claws 36 of the stacker 35 and the first members 41 of the vertical alignment members 40 move in the slits 34. For example, members axially supporting the vertical alignment members 40 and the stacker 35 are fixed to each other via not-illustrated members.

As illustrated in FIG. 3, the folding section 52 processes the sheets P in a position further in the +Z direction than the position where the sheets P are supported by the stacker 35. The folding section 52 folds the center in the Z direction of the sheets P and forms a fold on the sheets P. The folding section 52 includes a blade 53, a pair of folding rollers 54, and an additional folding unit 55.

The blade 53 has a flat shape and is parallel to an XY plane. The blade 53 has a shape tapered in the +X direction. The blade 3 is movable in the X direction piercing through the bed 32.

The pair of folding rollers 54 is present in the +X direction of the bed 32. The pair of folding rollers 54 is disposed side by side in the Z direction. Rotating shafts of the pair of folding rollers 54 extend in the Y direction.

The additional folding unit 55 is present in the +X direction of the pair of folding rollers 54. The additional folding unit 55 additionally folds the fold of the sheets P.

The stapling section 51 processes the sheets P in a position further in the +Z direction than the position where the sheets P are supported by the stacker 35. The stapling section 51 is present in the +Z direction of the folding section 52. The stapling section 51 applies stapling to a predetermined position of the sheets P. For example, the predetermined position of the sheets P is the center in the Z direction of the sheets P.

As illustrated in FIG. 1, the lower tray 28 is present in a lower part of the sheet processing device 200 in the +X direction of the additional folding unit 55. The saddle-folded sheets P are discharged to the lower tray 28.

The sheet processing device 200 includes a CPU (Central Processing Unit) 91, a memory 92, an auxiliary storage device 93, and the like connected by a bus as illustrated in FIG. 2 and executes a program. The sheet processing device 200 executes the program to thereby function as a device including the stapling mechanism 20, the saddle folding mechanism 30, and a communication section 94.

Figure 5:
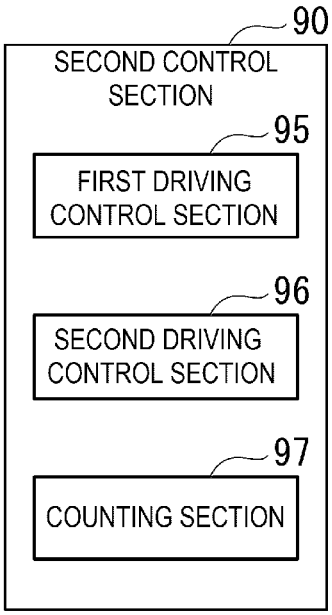
FIG. 5 is a block diagram illustrating a functional configuration of a CPU.

FIG. 5 is a block diagram illustrating a functional configuration of the second control section 90. As illustrated in FIG. 5, the CPU 91 executes a program stored in the memory 92 and the auxiliary storage device 93 to thereby function as the second control section 90. The second control section 90 controls operations of the sections of the sheet processing device 200. The second control section 90 includes a first driving control section 95 (a driving control section), a second driving control section 96, and a counting section 97. The first driving control section 95 controls the rotation driving section 43 to control the rotation driving of the vertical alignment members 40. The second driving control section 96 controls the lifting and lowering driving section 44 to control the movement in the Z direction of the stacker 35 and the vertical alignment members 40. The counting section 97 counts the number of sheets P conveyed to the sheet supporting section 31 and supported by the stacker 35.

The auxiliary storage device 93 is configured using a storage device such as a magnetic hard disk device or a semiconductor storage device. The auxiliary storage device 93 stores information.

The communication section 94 includes a communication interface for connecting the the sheet processing device 200 to an external device. The communication section 94 communicates with the external device via the communication interface.

FIGS. 6 to 10 are front views of the saddle folding mechanism 30 in the first embodiment. An operation of the saddle folding mechanism 30 in the first embodiment is explained with reference to FIGS. 6 to 10.

The user of the image forming apparatus 1 inputs a command to the operation section 14 of the image forming apparatus main body 100. For example, the user inputs a command for forming images on a plurality of sheets P and executing bookbinding of the plurality of sheets P. The first control section 80 of the image forming apparatus main body 100 transmits information concerning the number of sheets P to the second control section 90 of the sheet processing device 200.

The sheets P on which images are formed in the image forming apparatus main body 100 are conveyed to the saddle folding mechanism 30 of the sheet processing device 200 one by one. The sheets P are sequentially supported by the stacker 35 and stacked on the sheet supporting section 31. The counting section 97 of the sheet processing device 200 counts the number of sheets P stacked on the sheet supporting section 31.

Figure 6:
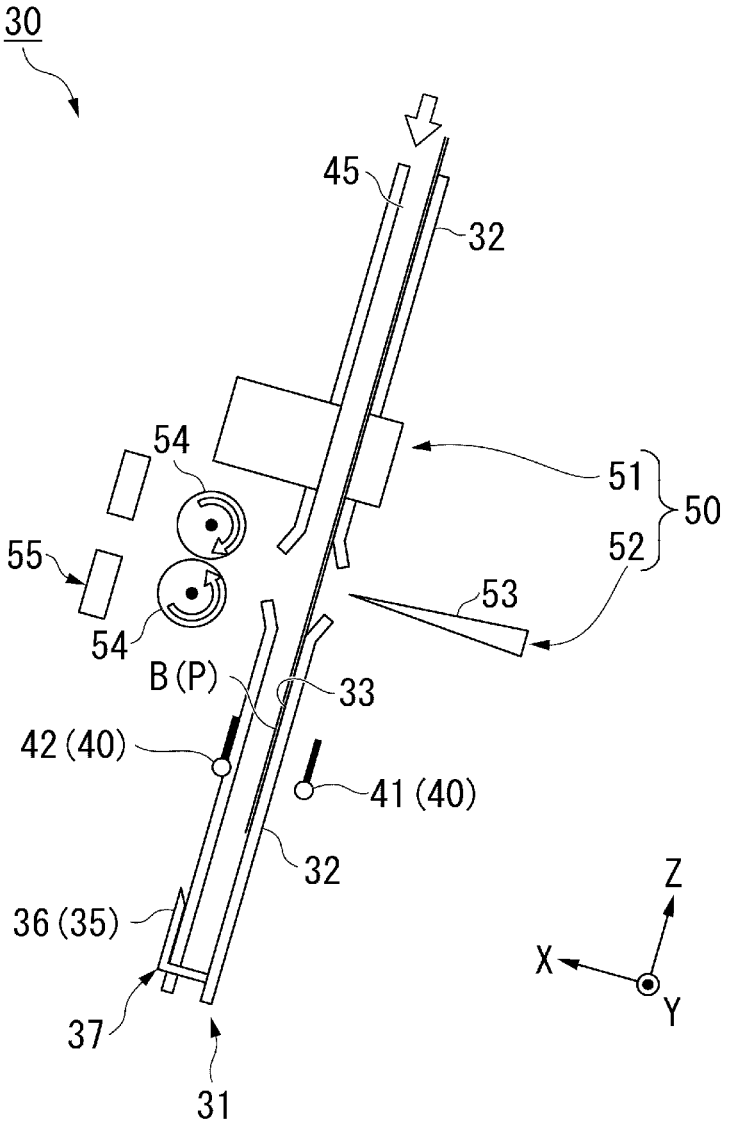
FIG. 6 is a front view of the saddle folding mechanism.
Figure 7:
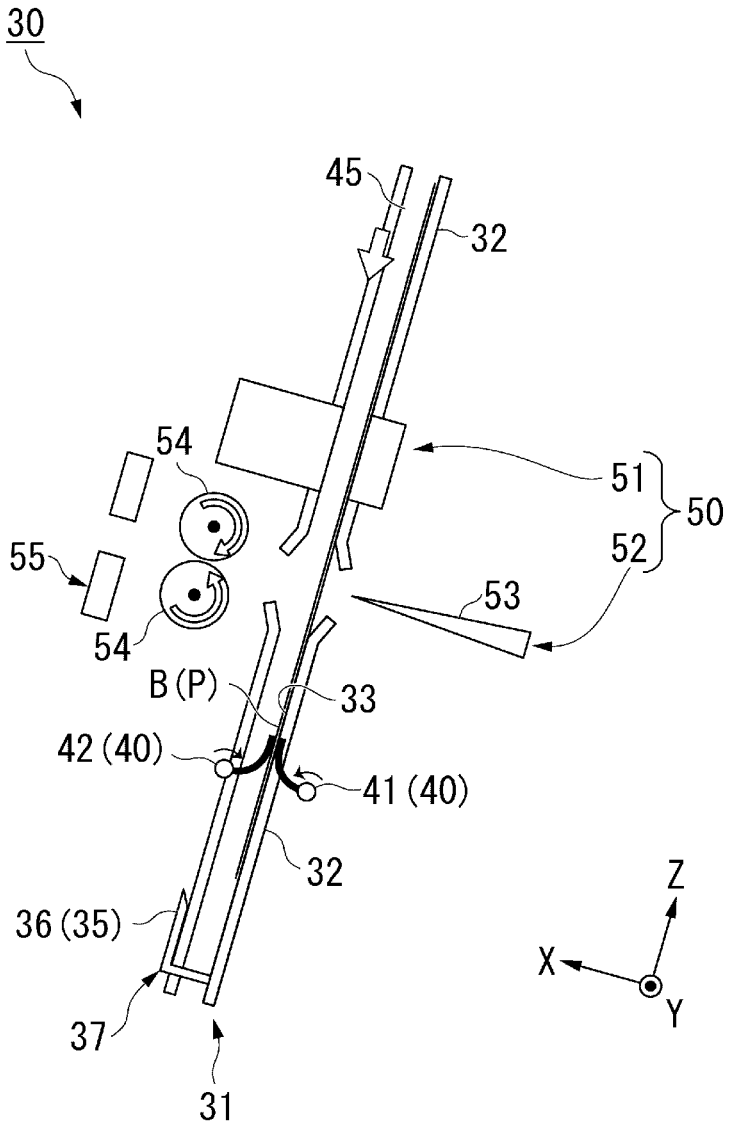
FIG. 7 is a front view of the saddle folding mechanism.
Figure 8:
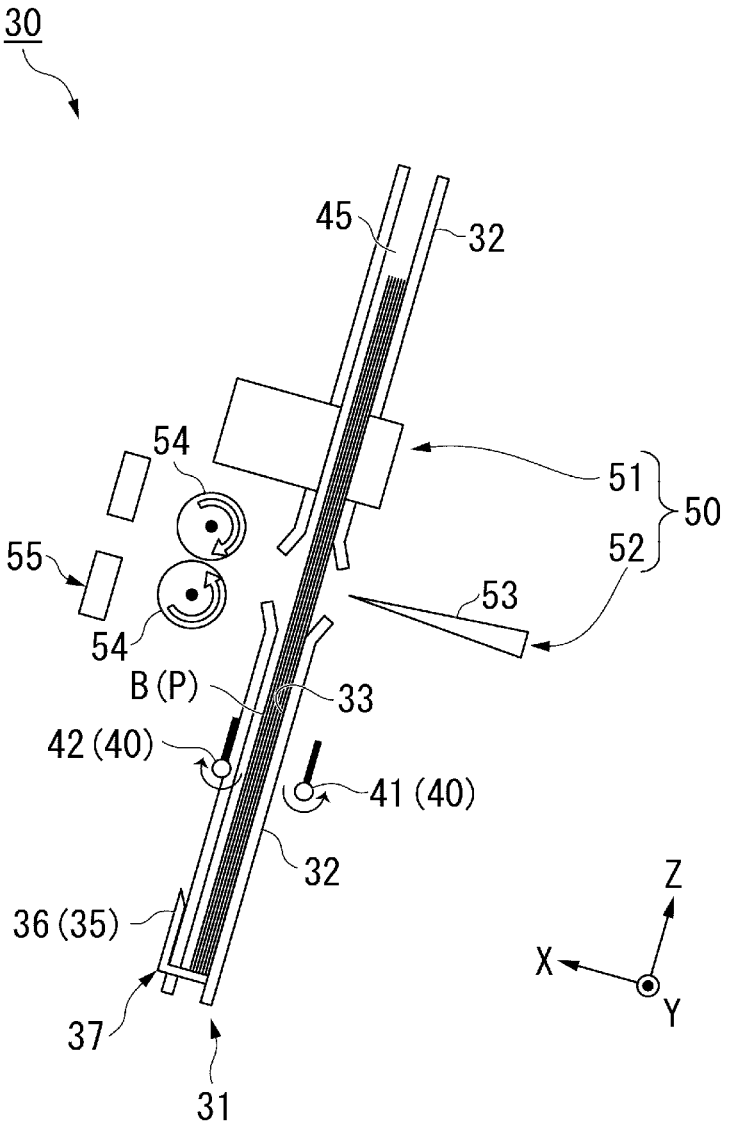
FIG. 8 is a front view of the saddle folding mechanism.

As illustrated in FIG. 6, the vertical alignment members 40 stay on standby in a retracted state from the conveyance path 45 until 1 the sheet P enters the sheet supporting section 31. As illustrated in FIG. 7, the vertical alignment members 40 are driven to rotate if the sheet P is present in a position facing the vertical alignment members 40. The vertical alignment members 40 rotate from a standby state to come into contact with the sheet P. The vertical alignment members 40 normally rotate such that contact sections of the vertical alignment members 40 with the sheet P are displaced in the −Z direction. The vertical alignment members 40 feed the sheet P in the −Z direction toward the stacker 35 with a frictional force acting between the vertical alignment members 40 and the sheet P. If the leading end of the sheet P fed toward the stacker 35 comes into contact with the claws 36 of the stacker 35, the vertical alignment members 40 further normally rotate while sliding with respect to the sheet P. A static frictional force acting between the vertical alignment members 40 and the sheet P is smaller than a force for buckling the sheet P that is in contact with the claws 36. The vertical alignment members 40 normally rotate while sliding with respect to the sheet P to prevent buckling from occurring in the sheet P. Thereafter, as illustrated in FIG. 8, the vertical alignment sections 40 stay on standby in the retracted state from the conveyance path 45.

The first driving control section 95 controls the rotation driving section 43 according to the number of sheets P counted by the counting section 97. As illustrated in FIG. 6, if the number of sheets P counted by the counting section 97 is zero, the first driving control section 95 drives both of the first members 41 and the second members 42 and feeds the sheet P toward the stacker 35. The first members 41 and the second members 42 hold a first sheet P to be stacked on the sheet supporting section 31 and feed the first sheet P toward the stacker 35.

If the number of sheets P counted by the counting section 97 is one or more, the first driving control section 95 drives only the second members 42 and feeds the sheets P toward the stacker 35. The first members 41 stay on standby in a retracted state from the conveyance path 45. If N is an integer equal to or larger than 2, the second members 42 hold, between the second members 42 and an already stacked N-1-th sheet P, an N-th sheet P to be stacked on the sheet supporting section 31. The second members 42 slide the N-th sheet P with respect to the N-1-th sheet P and feed the N-th sheet P toward the stacker 35.

Figure 9:
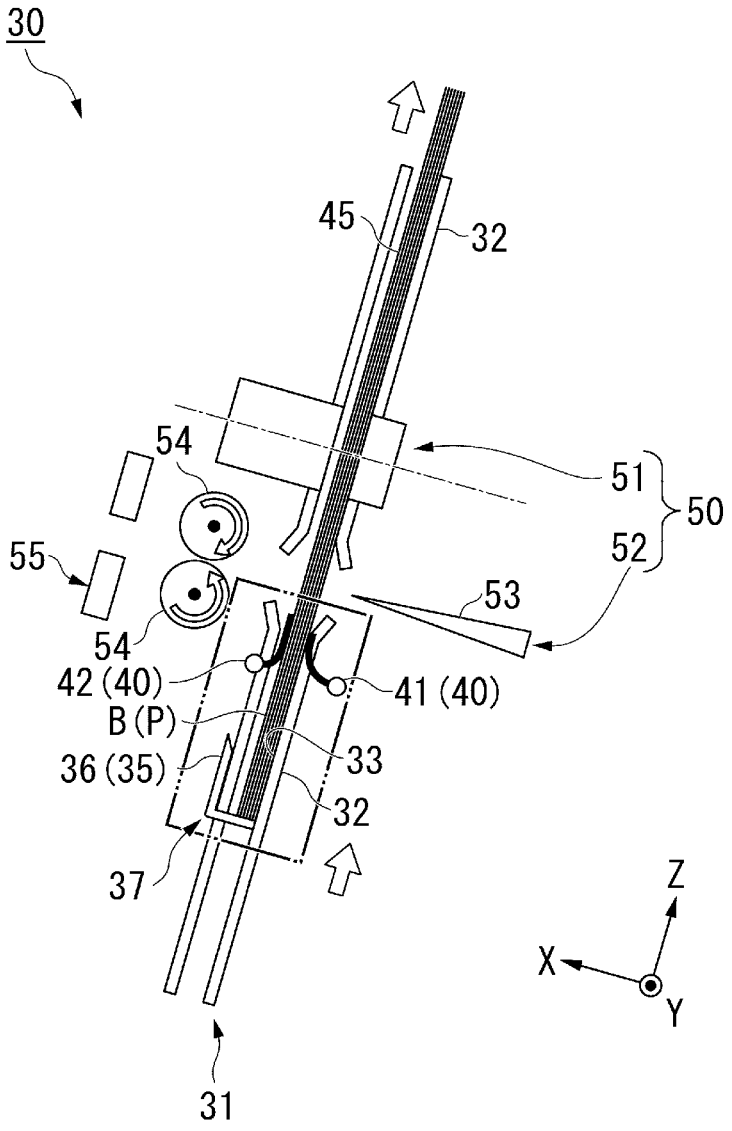
FIG. 9 is a front view of the saddle folding mechanism.

If the number of sheets P counted by the counting section 97 coincides with the number of sheets P included in information received from the first control section 80, the second control section 90 executes the following processing. The second control section 90 controls the rotation driving section 43 and the lifting and lowering driving section 44 to collectively convey all the sheets P stacked on the sheet supporting section 31 to a position where post processing is performed. All the sheets P stacked on the sheet supporting section 31 are one sheet P or the sheet bundle B. As illustrated in FIG. 9, the first driving control section 95 normally rotates the first members 41 and the second members 42 of the vertical alignment members 40 such that the vertical alignment members 40 sandwich all the sheets P from both the front and rear sides. The second driving control section 96 moves the vertical alignment members 40 in the Z direction integrally with the stacker 35 in a state in which the vertical alignment members 40 sandwich all the sheets P from both the front and rear sides.

The saddle folding mechanism 30 can execute bookbinding on the sheet bundle B. The bookbinding applies stapling and saddle folding to the sheet bundle B stacked on the sheet supporting section 31.

In the bookbinding, the stapling is applied to the sheet bundle B first. As illustrated in FIG. 9, the vertical alignment members 40 and the stacker 35 convey the sheet bundle B from a stack position to the stapling section 51. The vertical alignment members 40 and the stacker 35 dispose the center in the Z direction of the sheet bundle B in the stapling section 51. The stapling section 51 applies the stapling to the sheet bundle B conveyed to the stapling section 51.

Figure 10:
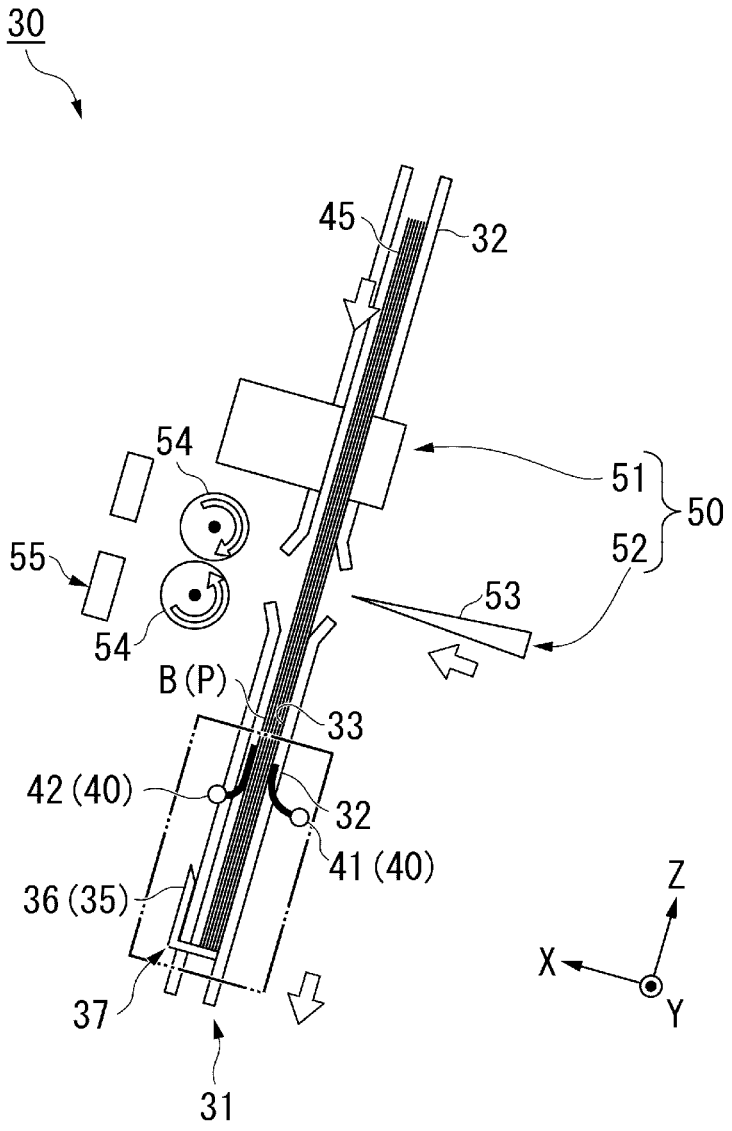
FIG. 10 is a front view of the saddle folding mechanism.

Subsequently, the saddle folding is applied to the stapled sheet bundle B. As illustrated in FIG. 10, the vertical alignment members 40 and the stacker 35 convey the stapled sheet bundle B to the folding section 52. The vertical alignment members 40 and the stacker 35 convey the center in the Z direction of the sheet bundle B to the folding section 52. The second control section 90 moves the blade 53 in the +X direction and pushes the sheet bundle B into a space between the pair of folding rollers 54. The sheet bundle B is saddle-folded in the center in the Z direction in a process of passing between the pair of folding rollers 54 and a fold is formed on the sheet bundle B. The second control section 90 drives the additional folding unit 55 to additionally fold the fold of the sheet bundle B. Consequently, the bookbinding of the sheet bundle B is completed. The bound sheet bundle B is discharged to the lower tray 28.

Instead of the bookbinding, the saddle folding mechanism 30 can apply the saddle folding to all the sheets P stacked on the sheet supporting section 31 without applying the stapling to the sheets P. In this case, the vertical alignment members 40 and the stacker 35 directly convey the sheet bundle B from the stack position to the folding section 52. Thereafter, as in the saddle folding in the bookbinding, a fold is formed on one sheet P or the sheet bundle B. The sheet (s) P on which the fold is formed is discharged to the lower tray 28.

The vertical alignment members 40 rotate the first members 41 and the second members 42 and release the stapled sheets P. In the bookbinding, the vertical alignment members 40 release the sheet bundle B before the saddle folding is applied to the sheet bundle B. However, the vertical alignment members 40 may release, before the stapling is applied to the sheet bundle B, the sheet bundle B conveyed to the stapling section 51. If the stapling is not applied and the saddle folding is applied to the sheets P, the vertical alignment members 40 release the sheets P after the sheets P are conveyed to the folding section 52. The vertical alignment members 40 may normally rotate or may reversely rotate the first members 41 and the second members 42 if releasing the sheets P. However, by normally rotating the first members 41 and the second members 42, it is possible to prevent the sheets P in contact with the vertical alignment members 40 from turning up. The vertical alignment members 40 may keep on holding the sheet bundle B if the blade 53 pushes the sheet bundle B into a space between the pair of folding rollers 54.

As explained in detail above, the sheet processing device 200 in this embodiment includes the vertical alignment members 40. The vertical alignment members 40 feed the sheets P in the Z direction toward the stacker 35 and are enabled to come into contact with the sheet bundle B supported by the stacker 35. The vertical alignment members 40 are movable integrally with the stacker 35 in the Z direction. With this configuration, it is possible to, with the vertical alignment members 40, bring the leading end of the sheets P into contact with the stacker 35 and vertically align the sheet bundle B. Further, it is possible to convey, with the stacker 35, the sheet bundle B to the stapling section 51 or the folding section 52 in a state in which the vertical alignment members 40 are pressed against the vertically aligned sheet bundle B. At this time, the vertical alignment members 40 come into contact with a part further in the +Z direction than the leading end of the sheets P in the sheet bundle B. Accordingly, it is possible to, while preventing deviation from being caused in the sheets P by the resistance of the conveyance path 45, convey the sheet bundle B from an initial position where the sheet bundle B is supported by the stacker 35 to the stapling section 51 or the folding section 52. Therefore, it is possible to prevent misalignment from occurring in the post-processed sheet bundle B. The vertical alignment members 40 can also be used as members that vertically align the sheet bundle B and members that are pressed against the sheet bundle B if the sheet bundle B is conveyed in the +Z direction. Therefore, it is possible to prevent an increase in component cost.

The vertical alignment members 40 come into contact with the sheet bundle B from both the front and rear sides. With this configuration, if the sheet bundle B is conveyed in the +Z direction, it is possible to prevent deviation from being caused in the sheets P on both the front and rear sides of the sheet bundle B by the resistance of the conveyance path 45.

The vertical alignment members 40 include the first members 41 and the second members 42 facing each other across the sheet bundle B. With this configuration, it is possible to hold the sheet bundle B from both the front and rear sides with the first members 41 and the second members 42. Therefore, if the sheet bundle B is conveyed in the +Z direction, it is possible to prevent deviation from being caused in the sheets P on both the front and rear sides of the sheet bundle B by the resistance of the conveyance path 45. Since positions where the first members 41 and the second members 42 come into contact with the sheet bundle B coincide in the Y direction, it is also possible to prevent the sheets P from deviating in the Y direction.

The vertical alignment members 40 move in the +Z direction together with the stacker 35 in a state in which the sheet bundle B is sandwiched from both the front and rear sides. Consequently, it is possible to convey the sheet bundle B to the stapling section 51 or the folding section 52 while preventing deviation from being caused in the sheets P on both the front and rear sides of the sheet bundle B by the resistance of the conveyance path 45. Therefore, it is possible to prevent misalignment from occurring in the post-processed sheet bundle B.

The first members 41 come into contact with the sheets P from the paper stacking surface 33 side of the bed 32. The second members 42 come into contact with the sheets P from the opposite side of the first members 41. Force of the first members 41 coming into contact with the sheets P is smaller than force of the second members 42 coming into contact with the sheets P. With this configuration, it is possible to prevent the first members 41 from being pressed against the sheet bundle B to separate the sheet bundle B from the paper stacking surface 33 of the bed 32. Therefore, it is possible to convey the sheet bundle B in the +Z direction along the paper stacking surface 33 of the bed 32 without separating the sheet bundle B from the conveyance path 45.

The slits 34 opened in the paper stacking surface 33 and extending in the Z direction are formed in the bed 32. The claws 36 of the stacker 35 move in the slits 34 if the claws 36 move in the Z direction. The first members 41 come into contact with the sheets P through the slits 34. With this configuration, the slits 34 in which the claws 36 of the stacker 35 move also function as the slits 34 in which the first members 41 move. Consequently, it is possible to prevent the shape of the bed 32 from being complicated. A part with which the stacker 35 comes into contact and a part with which the first members 41 come into contact in the sheets P coincide in the Y direction. Therefore, it is possible to prevent a moment from being generated in the sheets P by force in the +Z direction applied to the sheets P from the stacker 35 and force in the −Z direction applied to the sheets P from the first members 41. Therefore, it is possible to prevent the sheets P supported by the stacker 35 from being displaced to cause misalignment in the sheet bundle B.

The sheet processing device 200 includes the counting section 97 that counts the number of sheets P supported by the stacker 35 and the first driving control section 95 that controls driving of the vertical alignment members 40. The first driving control section 95 drives both of the first members 41 and the second members 42 and feeds the sheets P toward the stacker 35 if the number of sheets P counted by the counting section 97 is zero. The first driving control section 95 drives the second members 42 and feeds the sheets P toward the stacker 35 if the number of sheets P counted by the counting section 97 is one or more. With this configuration, the first members 41 are not driven in a state in which at least one sheet P is supported by the stacker 35. Accordingly, unnecessary force is not applied from the first members 41 to the first sheet P already supported by the stacker 35. Therefore, it is possible to prevent the sheets P supported by the stacker 35 from being displaced to cause misalignment in the sheet bundle B.

The stacker 35 includes the restricting section 37 that comes into contact with the sheets P from the −Z direction. The vertical alignment members 40 come into contact with the sheets P only further on the inner side than both the ends of the restricting section 37 in the Y direction. With this configuration, even if the vertical alignment members 40 apply force directed to the restricting section 37 side to the sheets P supported by the restricting section 37, moment does not occur in the sheets P. Therefore, it is possible to prevent the sheets P supported by the restricting section 37 from being displaced to cause misalignment in the sheet bundle B.

The vertical alignment members 40 elastically come into contact with the sheet bundle B. With this configuration, it is possible to prevent the vertical alignment members 40 from coming into contact with the sheet bundle B with excessive force. Therefore, it is possible to prevent the sheets P from being stained if the vertical alignment members 40 feed the sheets P toward the stacker 35.

The vertical alignment members 40 are the plate-like paddles having flexibility. With this configuration, it is possible to obtain the vertical alignment members 40 that elastically come into contact with the sheet bundle B. Therefore, it is possible to achieve the action effects explained above.

The post processing section 50 includes the stapling section 51 that performs stapling on the sheets P. With this configuration, since the vertically aligned sheet bundle B is conveyed to the stapling section 51, it is possible to bind the sheet bundle B in desired positions of the sheets P.

The post processing section 50 includes the folding section 52 that saddle-folds the sheets P. With this configuration, since the vertically aligned sheet bundle B is conveyed to the folding section 52, it is possible to form a fold in a desired position of the sheets P.

Second Embodiment

Figure 11:
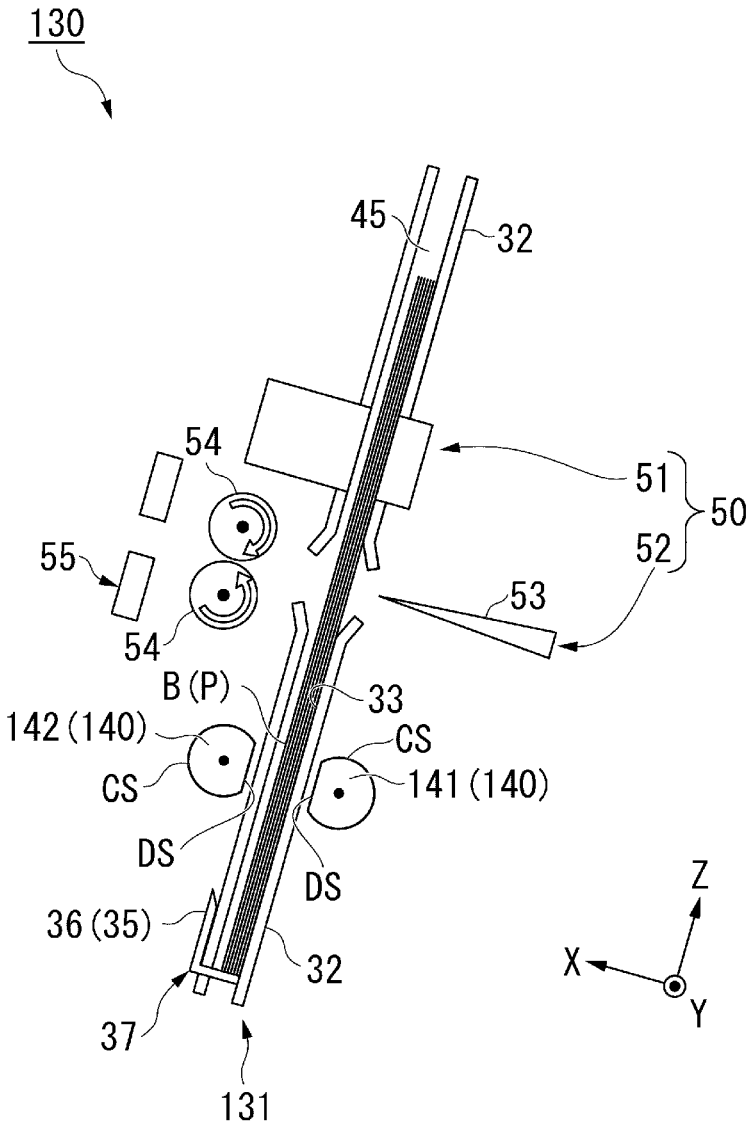
FIG. 11 is a front view illustrating a schematic configuration of a saddle folding mechanism in a sheet processing device in a second embodiment.

FIG. 11 is a front view illustrating a schematic configuration of a saddle folding mechanism 130 in the sheet processing device 200 in a second embodiment. In the first embodiment illustrated in FIG. 3, the vertical alignment members 40 are the paddles having flexibility. In the second embodiment illustrated in FIG. 11, vertical alignment members 140 are rollers. Components other than components explained below are the same as the components in the first embodiment.

Figure 12:
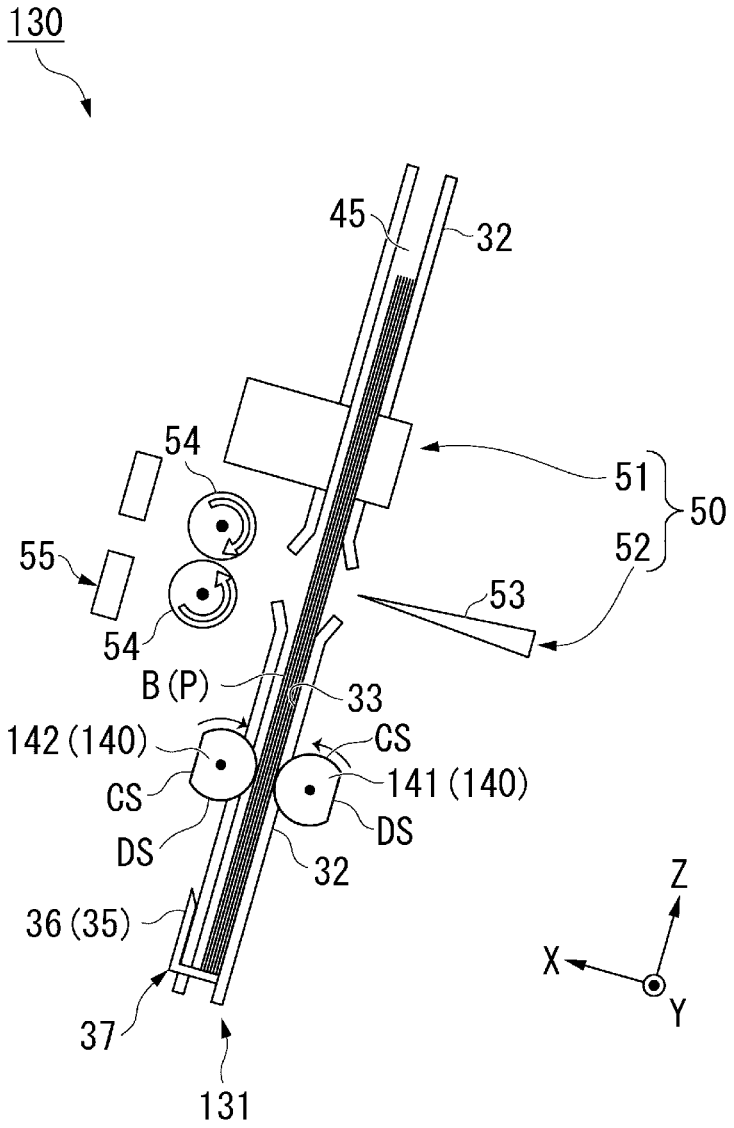
FIG. 12 is a front view of the saddle folding mechanism in the second embodiment.

As illustrated in FIG. 12, a sheet supporting section 131 includes the vertical alignment members 140 instead of the vertical alignment members 40 in the first embodiment. The vertical alignment members 140 are rollers including D-cut surfaces DS. In the following explanation, portions excluding the D-cut surfaces DS in the outer circumferential surfaces of the vertical alignment members 140 are referred to as columnar surfaces CS. For example, the outer circumferential surfaces of the vertical alignment members 140 are formed by an elastic member such as sponge. The vertical alignment members 140 respectively rotate centering on axes extending in the Y direction. The vertical alignment members 140 cause the outer circumferential surfaces to approach and separate from the sheets P according to the rotation. The D-cut surfaces DS of the vertical alignment members 140 are incapable of coming into contact with the sheet bundle B. The columnar surfaces CS of the vertical alignment members 140 are capable of coming into contact with the sheet bundle B. The vertical alignment members 140 bring the outer circumferential surfaces into contact with the sheet bundle B to elastically come into contact with the sheet bundle B while involving elastic deformation of the outer circumferential surfaces. The vertical alignment members 140 are capable of moving with the stacker 35 in the Z direction.

The vertical alignment members 140 include first members 141 and second members 142 instead of the first members 41 and the second members 42 in the first embodiment. The first members 141 and the second members 142 are driven to rotate independently of each other by the rotation driving section 43. The first members 141 and the second members 142 are moved in the Z direction together with the stacker 35 by the lifting and lowering driving section 44.

Force of the first members 141 coming into contact with the sheets P is smaller than force of the second members 142 coming into contact with the sheets P. For example, compared with a rotation axis of the second members 142, a rotation axis of the first members 141 are present in a position farther from the sheets P. The rotation axis of the first members 141 is set away from the sheets P to reduce the force of the first members 141 coming into contact with the sheets P. For example, compared with the second members 142, the first members 141 are more easily elastically deformed if the outer circumferential surfaces come into contact with the sheets P. The outer circumferential surfaces of the first members 141 are allowed to be easily elastically deformed to reduce the force of the first members 141 coming into contact with the sheets P. For example, shapes such as outer diameters of the first members 141 and the second members 142 may be differentiated. For example, materials of the first members 141 and the second members 142 may be differentiated.

FIG. 12 is a front view of the saddle folding mechanism 130 in the second embodiment. An operation of the saddle folding mechanism 130 in the second embodiment is explained with reference to FIGS. 11 and 12.

As illustrated in FIG. 11, the vertical alignment members 140 stay on standby in a retracted state from the conveyance path 45 until the sheets P enter the sheet supporting section 131. The vertical alignment members 140 direct the D-cut surfaces DS to the conveyance path 45 side to retract from the conveyance path 45. As illustrated in FIG. 12, the vertical alignment members 140 are driven to rotate if the sheets P are present in a position facing the vertical alignment members 140. The vertical alignment members 140 rotate from the standby state to come into contact with the sheets P. The vertical alignment members 140 normally rotate to feed the sheets P in the −Z direction. The vertical alignment members 140 feed the sheets P in the −Z direction toward the stacker 35 with a frictional force acting between the columnar surfaces CS of the vertical alignment members 140 and the sheets P. If the leading end of the sheets P fed toward the stacker 35 comes into contact with the claws 36 of the stacker 35, the vertical alignment members 140 further normally rotate while sliding with respect to the sheets P. A static frictional force acting between the vertical alignment members 140 and the sheets P is smaller than force for buckling the sheets P that are in contact with the claws 36. The vertical alignment members 140 normally rotate while sliding with respect to the sheets P to prevent buckling from occurring in the sheets P. Thereafter, the vertical alignment sections 140 stay on standby in the retracted state from the conveyance path 45.

If the vertical alignment members 140 convey the sheets P to the post processing section 50 in cooperation with the stacker 35, the vertical alignment members 140 normally rotate from the standby state and bring the columnar surfaces CS into contact with the sheets P. The vertical alignment members 140 bring the columnar surfaces CS of the first members 141 and the second members 142 into contact with the sheets P to sandwich all the sheets P from both the front and rear sides. The vertical alignment members 140 are displaced in the Z direction integrally with the stacker 35 in a state in which all the sheets P are sandwiched from both the front and rear sides.

In this embodiment, the same effects as the effects in the first embodiment are achieved. In addition, since the vertical alignment members 140 are the rollers including the D-cut surfaces DS, by rotating the vertical alignment members 140, it is possible to cause the vertical alignment members 140 to approach and separate from the sheets P. Therefore, the vertical alignment members 140 that feed the sheets P in the Z direction toward the stacker 35 and is capable of coming into contact with the sheet bundle B supported by the stacker 35 is obtained.

In the second embodiment, the vertical alignment members 140 are elastically in contact with the sheet bundle B while involving elastic deformation of the outer circumferential surfaces of the vertical alignment members 140. However, the vertical alignment members 140 are not limited to this configuration. Rotating shafts of rollers including D-cut surfaces may be elastically supported to be displaceable in the X direction. With this configuration, even if the outer circumferential surfaces of the rollers are formed by a hard material, the vertical alignment members 140 can elastically come into contact with the sheets P.

In the embodiments explained above, the restricting section 37 that comes into contact with, from the −Z direction, the sheets P stacked on the sheet supporting sections 31 and 131 is configured by only the claws 36 of the stacker 35. However, the restricting section may include claws that do not move in the Z direction other than the claws 36 of the stacker 35. Even in this case, the action effects explained above can be achieved by bringing the vertical alignment members into contact with the sheets P only further on the inner side than both the ends of the entire restricting section in the Y direction.

In the embodiments explained above, the vertical alignment members come into contact with a bundle of sheets from both the front and rear sides. However, the vertical alignment members are not limited to this configuration. The vertical alignment members may include only members equivalent to the second members that come into contact with sheets from the opposite side of the paper stacking surface of the bed. In this case, the sheet supporting section desirably includes a counter member that faces the vertical alignment members across the sheets and sandwiches the sheet bundle between the counter member and the vertical alignment members. The counter member moves in the Z direction integrally with the vertical alignment members and the stacker. That is, in the counter member, a function of feeding the sheets toward the stacker is omitted from the first members in the embodiments. With this configuration, the same action effects as the action effects in the embodiments can be achieved.

According to at least one of the embodiments explained above, the sheet processing device includes the vertical alignment members. The vertical alignment members feed sheets in the conveying direction toward the stacker. The vertical alignment members are enabled to come into contact with a sheet bundle supported by the stacker. The vertical alignment members are movable integrally with the stacker in the conveying direction. Consequently, it is possible to convey the sheet bundle to the post processing section with the stacker in a state in which the vertical alignment members are pressed against the vertically aligned sheet bundle. Accordingly, it is possible to, while preventing deviation from being caused in the sheets by the resistance of the conveyance path, convey the sheet bundle from an initial position where the sheet bundle is supported by the stacker to the post processing section. Therefore, it is possible to prevent misalignment from occurring in the post-processed sheet bundle.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A sheet processing device, comprising:

a conveyance path for conveying sheets in a conveying direction and stacking the sheets;

a stacker configured to restrict a leading end of the conveyed sheets and movable in the conveying direction;

a post processing section configured to process the sheets further on an upstream side in the conveying direction relative to a position where the sheets are supported by the stacker; and vertical alignment members configured to feed the sheets in the conveying direction toward the stacker, enabled to come into contact with a bundle of the sheets supported by the stacker, and movable in the conveying direction integrally with the stacker, wherein the vertical alignment members come into contact with the bundle of the sheets from both a front side and a rear side.

2. The sheet processing device according to claim 1, wherein the vertical alignment members include a first member and a second member facing each other across the bundle of the sheets.

3. The sheet processing device according to claim 1, wherein the vertical alignment members move to an upstream side in the conveying direction together with the stacker in a state in which the vertical alignment members sandwich the bundle of the sheets from both the front and rear sides.

4. The sheet processing device according to claim 1, further comprising a bed including a paper stacking surface that faces further upward than a horizontal direction and supports the sheets supported by the stacker, wherein the vertical alignment members include a first member configured to contact the bundle of the sheets from the paper stacking surface side and a second member configured to contact the bundle of the sheets from an opposite side of the first member, and a first force of the first member coming into contact with the sheets is smaller than a second force of the second member coming into contact with the sheets.

5. The sheet processing device according to claim 1, further comprising a bed including a paper stacking surface that faces further upward than a horizontal direction and supports the sheets supported by the stacker, slits opened in the paper stacking surface and extending in the conveying direction being formed in the bed, wherein the stacker moves in the slits if moving in the conveying direction, and the vertical alignment members come into contact with the sheets through the slits.

6. The sheet processing device according to claim 1, further comprising:

a bed including a paper stacking surface that faces further upward than a horizontal direction and supports the sheets supported by the stacker;

a counting component configured to count a number of the sheets supported by the stacker; and a driving controller configured to control driving of the vertical alignment members, wherein the vertical alignment members include a first member configured to contact the bundle of the sheets from the paper stacking surface side and a second member configured to contact the bundle of the sheets from an opposite side of the first member, and the driving controller drives both of the first member and the second member and feeds the sheets toward the stacker if the number of the sheets counted by the counting component is zero, and drives the second member and feeds the sheets toward the stacker if the number of the sheets counted by the counting component is one or more.

7. The sheet processing device according to claim 1, wherein a width direction is orthogonal to the conveying direction, the stacker includes a restricting component configured to come into contact with the sheets from a downstream side in the conveying direction, and the vertical alignment members come into contact with the sheets only further on an inner side than both ends of the restricting component in the width direction.

8. The sheet processing device according to claim 1, wherein the vertical alignment members are plate-like paddles having flexibility.

9. The sheet processing device according to claim 1, wherein the vertical alignment members are rollers including D-cut surfaces.

10. A sheet processing method, comprising:

conveying sheets along a conveyance path in a conveying direction and stacking the sheets;

restricting a leading end of the conveyed sheets by a stacker movable in the conveying direction;

processing the sheets on an upstream side in the conveying direction relative to a position where the sheets are supported by the stacker;

feeding the sheets with vertical alignment members in the conveying direction toward the stacker, enabling the vertical alignment members to come into contact with a bundle of the sheets supported by the stacker and moving the vertical alignment members in the conveying direction integrally with the stacker; and contacting the vertical alignment members with the bundle of the sheets from both a front side and a rear side.

11. An image forming apparatus, comprising:

an image forming component; and sheet processing device, comprising:

a conveyance path for conveying sheets in a conveying direction and stacking the sheets;

a stacker configured to restrict a leading end of the conveyed sheets and movable in the conveying direction;

a post processing section configured to process the sheets further on an upstream side in the conveying direction relative to a position where the sheets are supported by the stacker; and vertical alignment members configured to feed the sheets in the conveying direction toward the stacker, enabled to come into contact with a bundle of the sheets supported by the stacker, and movable in the conveying direction integrally with the stacker, wherein the vertical alignment members come into contact with the bundle of the sheets from both a front side and a rear side.

12. The image forming apparatus according to claim 11, wherein the vertical alignment members include a first member and a second member facing each other across the bundle of the sheets.

13. The image forming apparatus according to claim 11, wherein the vertical alignment members move to an upstream side in the conveying direction together with the stacker in a state in which the vertical alignment members sandwich the bundle of the sheets from both the front and rear sides.

14. The image forming apparatus according to claim 11, further comprising a bed including a paper stacking surface that faces further upward than a horizontal direction and supports the sheets supported by the stacker, wherein the vertical alignment members include a first member configured to contact the bundle of the sheets from the paper stacking surface side and a second member configured to contact the bundle of the sheets from an opposite side of the first member, and a first force of the first member coming into contact with the sheets is smaller than a second force of the second member coming into contact with the sheets.

15. The image forming apparatus according to claim 11, further comprising a bed including a paper stacking surface that faces further upward than a horizontal direction and supports the sheets supported by the stacker, slits opened in the paper stacking surface and extending in the conveying direction being formed in the bed, wherein the stacker moves in the slits if moving in the conveying direction, and the vertical alignment members come into contact with the sheets through the slits.

16. The image forming apparatus according to claim 11, further comprising:

a bed including a paper stacking surface that faces further upward than a horizontal direction and supports the sheets supported by the stacker;

a counting component configured to count a number of the sheets supported by the stacker; and a driving controller configured to control driving of the vertical alignment members, wherein the vertical alignment members include a first member configured to contact the bundle of the sheets from the paper stacking surface side and a second member configured to contact the bundle of the sheets from an opposite side of the first member, and the driving controller drives both of the first member and the second member and feeds the sheets toward the stacker if the number of the sheets counted by the counting component is zero, and drives the second member and feeds the sheets toward the stacker if the number of the sheets counted by the counting component is one or more.

17. The image forming apparatus according to claim 11, wherein the vertical alignment members are one of:

plate-like paddles having flexibility, or rollers including D-cut surfaces.

* * * * *